United States Patent [19]

Cramer et al.

[11] 4,064,875

[45] Dec. 27, 1977

[54] ANTI-SUFFOCATION MEANS FOR AIRCRAFT BREATHING MASK

[75] Inventors: Robert L. Cramer; Jack E. Dunbar; James A. Mientus, all of Davenport, Iowa

[73] Assignee: The Bendix Corporation, South Bend, Ind.

[21] Appl. No.: 701,781

[22] Filed: July 2, 1976

[51] Int. Cl.[2] ..... A62B 7/00

[52] U.S. Cl. ..... 128/142.2; 128/142.4; 128/142.6; 128/145 R

[58] Field of Search ..... 128/142.2, 142 R, 142.3, 128/142.4, 142.5, 142.6, 142.7, 145 R, 145 A, 146.5, 146 R, 146.4, 146.6, 147, 191 R, 203

[56] References Cited

U.S. PATENT DOCUMENTS

| | | | |
|---|---|---|---|
| 3,129,707 | 4/1964 | Becker et al. | 128/142.2 |
| 3,189,027 | 6/1965 | Bartlett, Jr. | 128/146.5 |
| 3,577,988 | 5/1971 | Jones | 128/191 R |
| 3,768,466 | 10/1973 | Johnson | 128/142.2 |

FOREIGN PATENT DOCUMENTS

| | | | |
|---|---|---|---|
| 1,431,331 | 12/1968 | Germany | 128/145 R |
| 356,547 | 9/1931 | United Kingdom | 128/145 R |

*Primary Examiner*—Robert W. Michell
*Assistant Examiner*—Henry J. Recla
*Attorney, Agent, or Firm*—Leo H. McCormick, Jr.; Ken C. Decker

[57] ABSTRACT

An emergency breathing system has an anti-suffocation valve located in a housing between a source of breathable fluid and a distribution mask. The housing has a chamber which is connected to the distribution mask and an opening which connects the chamber with the surrounding environment. The anti-suffocation valve responds to an inhalation demand of a recipient to allow air from the surrounding environment to enter the chamber and satisfy the inhalation demand of a recipient to allow air from the surrounding environment to enter the chamber and satisfy the inhalation demand. A hydrophobic filter surrounds the opening and prevents the entry of any water present in the surrounding environment into the chamber which could inhibit cyclic inhalation of breathable fluid by the recipient.

7 Claims, 2 Drawing Figures

ANTI-SUFFOCATION MEANS FOR AIRCRAFT BREATHING MASK

BACKGROUND OF THE INVENTION

This invention relates to an anti-suffocation means for use in an emergency breathing system of an aircraft pilot.

Emergency breathing systems are primarily designed to provide pilots with a limited amount of breathable fluid during bail out situations. The breathable fluid is retained in a storage container carried by the pilot. The flow of breathable fluid from the storage container is normally controlled by a regulator, such as illustrated in U.S. Pat. No. 2,523,906. The regulator cycles the breathable fluid from the storage container as a function of an inhalation demand by the pilot. When the emergency supply of breathable fluid is exhausted, an inhalation force opens a fixed pressure valve and allows air from the surrounding environment to enter the breathing system. As long as the pilot bails out over land this type of regulator performs satisfactorily; but, unfortunately, many times aircraft pilots are required to bail out over water. If an injured or unconscious pilot lands in water and thereafter the fixed pressure valve is opened, water can enter the breathing system and drown the pilot.

SUMMARY OF THE INVENTION

We have devised an anti-suffocation means having filter means which prevents any water from entering a breathing system which could affect the breathing of a pilot.

The anti-suffocation means includes a housing which has a chamber therein through which breathable fluid is communicated to a distribution mask affixed to the face of a pilot. The housing has an opening which connects the chamber with the surrounding environment. A poppet valve means is resiliently biased against a seat to seal the opening from the surrounding environment. A hydrophobic filter which covers the opening prevents any water present in the surrounding environment from entering into the chamber and contaminating the breathing system. Therefore, whenever an injured or unconscious aircraft pilot falls into water he is fully protected against drowning when an inhalation demand opens an anti-suffocation valve since only air can pass through the hydrophobic filter.

It is therefore the object of this invention to provide an emergency breathing system with an anti-suffocation means having filter means which prevents the entry of water into the breathing system.

It is another object of this invention to provide a breathing system with an anti-suffocation means which allows only air from a surrounding environment to enter a breathing system and meet an inhalation demand of a recipient.

It is a further object of this invention to provide a means for preventing drowning of a pilot who lands in water whenever an anti-suffocation valve opens in response to an inhalation demand.

These and other objects will become apparent from reading this specification and viewing the drawings.

DETAILED DESCRIPTION OF THE INVENTION

Figure 1:
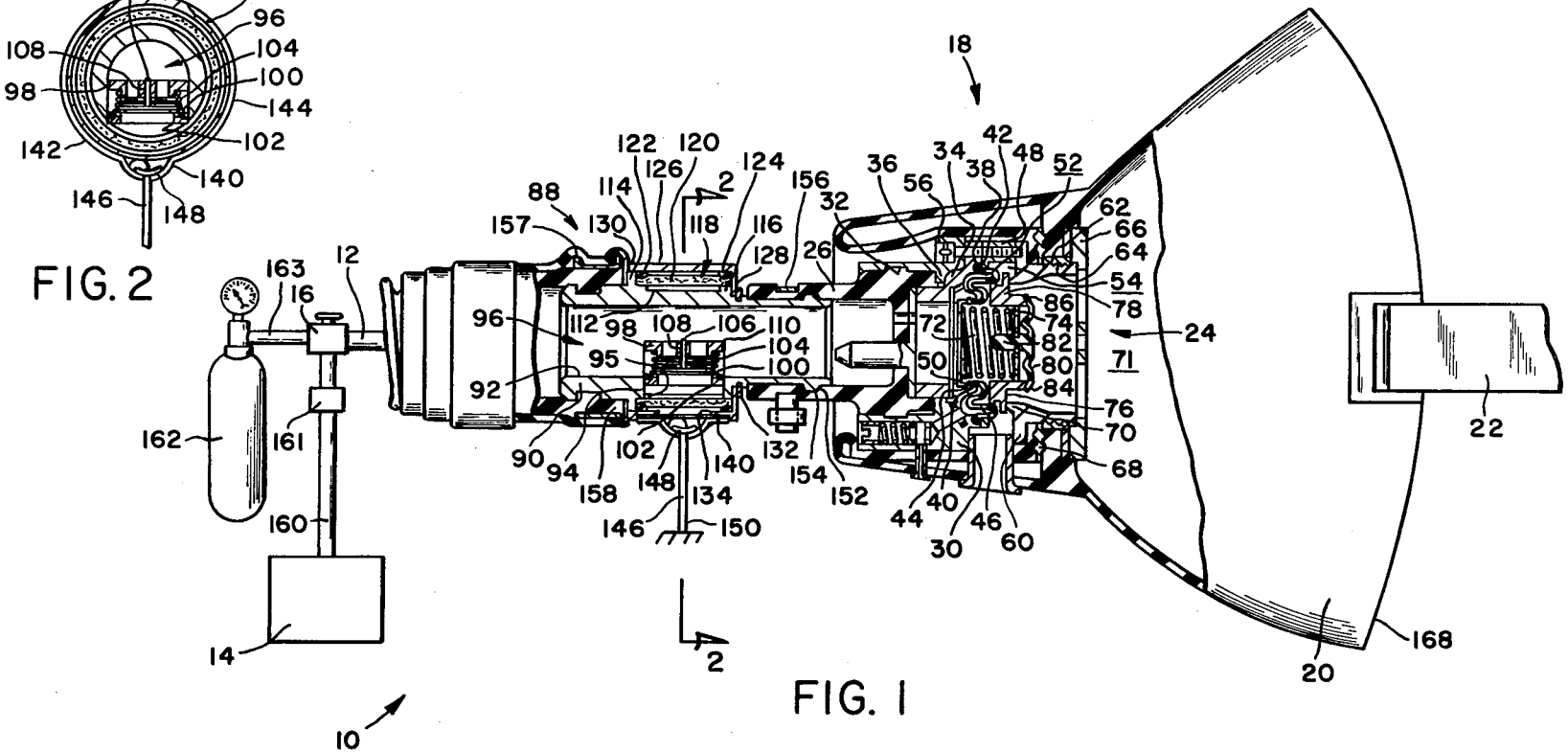
FIG. 1 is a sectional view of an anti-suffocation means, made according to the present invention, which is connected to a distribution mask of an emergency breathing system.

The breathing system 10, shown in FIG. 1, has a conduit 12 which connects a central supply of breathable fluid retained in container 14 to a distribution mask 18 affixed to the face of a pilot. The supply of breathable fluid in container 14 can either be replenished by an onboard aircraft oxygen generation system such as disclosed in U.S. Pat. No. 3,948,286 or a liquid to oxygen aircraft conversion system such as disclosed in U.S. Pat. No. 3.707,078.

A pressure regulator 16, such as disclosed in U.S. Pat. No. 2,523,206, is located in conduit 12 between a distribution means 18 and the supply container 14. The pressure regulator means to compensate for changes in the operating parameters of an aircraft in order to provide the distribution mask or means 18 with a constant supply of breathable fluid capable of meeting the physiological demands of a pilot.

The distribution means 18 includes a breathing mask 20 which is attached to the nasal-mouth area of a pilot by strap 22. The breathing mask 20 has an inhalation-exhalation valve means 24 similar to that disclosed in U.S. Pat. No. 2,954,793 for controlling the communication of fluid from conduit 12 into the distribution mask or means 18. An adapter 26 connects the inhalation-exhalation valve 24 to conduit 12.

The inhalation-exhalation valve means 24 has a housing 30 with a bore 32 therethrough. A sleeve 34 which is located in bore 32 adjacent shoulder 36 has a first groove 38 and a second groove 40 located thereon for retaining beads 42 and 44 of a diaphragm 46 in a fixed position. The diaphragm 46 separates the bore 32 into a pressure chamber 52 from exhaust chamber 54. The diaphragm 46 is located in bore 32 by a spacer 48 and a retainer 50 which hold beads 42 and 44 in the first and second grooves 38 and 40, respectively.

A fastener screw 56 extends through the spacer 48 and joins housing 30 with tubular means 60. The tubular means 60 has threads 62 on the end thereof which are mated with threads 64 on support plate 66 to hold annular rib 68 against tubular means 60 and establish a seal between the interior 71 of the breathing mask 20, and the surrounding environment.

The tubular means 60 has an annular rib 70 which extends into the exhaust chamber 54 to form an inhalation valve seat. A spring 72 located between retainers 44 and 74 holds face 76 of tubular means 78 against rib 70 to seal the exhaust chamber 54 from the interior 71 of the breathing mask 20.

A flapper valve 80 has a projection 82 which is secured to retainer 74. The peripheral surface 84 of the flapper valve 80 has a contour which matches the contour 86 on the end of the tubular means 78.

An anti-suffocation means 88 is located in conduit 12 adjacent adapter 26 and has a housing 90 with an axial bore 92 extending therethrough which permits breathable fluid to freely flow from the supply container 14 to the breathing mask 20. A cross bore 94 which has a slightly larger diameter than bore 92, extends into the axial bore 92 to provide an opening 95 with the surrounding environment to permit air to be communicated into conduit 12. A valve means 96 is located in cross bore 94 to control communication between the axial bore 92 and the surrounding environment.

Figure 2:
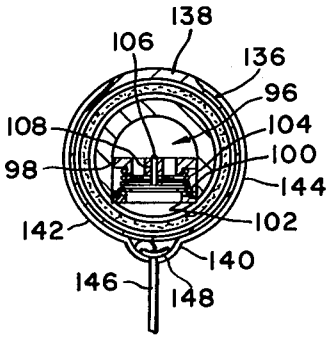
FIG. 2 is a sectional view taken along line 2—2 of FIG. 1.

The valve means 96 as best illustrated in FIG. 2 has a poppet 100 which is held against an annular seat 102 by a spring 104. The poppet 100 has a projection 106 which extends through an opening 108 in support or guide 98. The support or guide means 98 which abuts a shoulder 110 formed between the intersection of bores 92 and 94, holds the face on poppet 100 parallel with annular seat 102.

An annular groove 112 is located on the periphery of housing 90 between shoulder 114 and 116. A filter means 118 includes a membrane 120 which is positioned over groove 112 by first and second O rings 122 and 124. The membrane 120 is a microporous film of polyvinyl chloride acrylonitrile copolymer. The membrane 120 has mean pore size of between .2 and .8 microns which prevents the transmission of water and other contaminants into opening 95 through groove 112.

A sleeve 126 which surrounds shoulder 114 has a leg 128 which abuts shoulder 116. A snap ring 132 holds leg 128 against shoulder 116 to position end 130 over shoulder 114 to protect the membrane 120 from being damaged by an external force. The sleeve 126 has an opening 134 which permits air from the surrounding environment to be communicated to the filter means 118. The peripheral surface of sleeve 126 has a groove 136 which extends to stop 138 on the top side thereof.

A metal clip 140 has a first leg 142 and a second leg 144 positioned in groove 136 to seal opening 134 from the surrounding environment. The groove 136 is painted a bright color, such as red. If groove 136 is not completely covered by clip 140 the pilot is provided with an indication that opening 134 is not sealed. If opening 134 is not completely covered, during some aircraft maneuvers it is possible to induce inhalation conditions which could open valve means 96 and allow air to enter conduit 12 and cause physiological damage to the pilot.

A lanyard 146 has one end 148 attached to the metal clip 140 and a second end 150 fixed to the housing of the aircraft.

The housing 90 of the anti-suffocation means 88 has a rib 152 which is positioned in groove 154 in adapter 26. A first clamp 156 surrounds the adapter to provide a seal between housing 90 and the adapter 26 and prevent separation therebetween upon removal of clip 140 by a dynamic force. Similarly, a second clamp 157 secures the other end of housing 90 to the end 158 of conduit 12.

The pressure regulator 16 which has a break away connection 161 located in conduit 160 of the central supply 14, is fixed to connection 163 of the emergency supply container 162 carried on the person of the pilot.

MODE OF OPERATION OF THE EMBODIMENT

When an aircraft pilot enters an aircraft, part of the preflight checkout, includes checking the emergency oxygen or breathable fluid in container 162 to assure that a sufficient quantity of emergency oxygen is retained therein to maintain physiological requirement for about 30 minutes. Thereafter the regulator 16 is connected to the central supply container 14 by conduit 160. When regulator 16 is connected to conduit 160, flow of breathable fluid from the emergency supply container 162 is prohibited.

A further part of the preflight checkout requires that the pilot check to make sure that the metal clip 140 is positioned on sleeve 126 in such a manner that the opening 134 is sealed from the surrounding environment to assure that an inhalation demand can not open the valve means 96 and allow air from the surrounding environment to enter the breathing system.

Thereafter, the pilot places strap 22 on his head and adjusts the breathing mask 20 over his nose and mouth to form a seal between the peripheral surface 168 and his face to permit the breathing fluid retained in container 14 to flow in conduit 12. When the pilot inhales, flapper 80 moves away from end 86 and allows breathable fluid present in condit 12 to flow into the interior 71 of the breathing mask 20 and meet his breathing demands. When the pilot exhales, flapper 80 is seated on end 86 and face 76 moves away from rib 70 to allow breathed air in the interior 71 of the mask 20 to be communicated to the surrounding environment through exhaust chamber 54. This type of cycling operation continues as long as there is a supply of breathable fluid presented to conduit 12.

If an emergency should occur that requires the aircraft pilot to abandon the aircraft by ejection, lanyard 146 holds the metal clip 140 in the aircraft and thereby breaks the seal between opening 134 and the surrounding environment. The position of opening 134 on sleeve 126, protects poppet valve 96 from any direct wind forces which the pilot may experience during his bailout. Without any additional force poppet valve 96 remains closed during descent to allow the pilot to breathe fluid from container 16 at a normal inhalation-exhalation rate.

If the pilot has bailed out over land, upon touchdown, the breathing mask 20 is removed. However, if the pilot is unable to remove the breathing mask 20, when the breathable fluid supply in container 162 is depleted, each inhalation demand, overcomes spring 104 to allow air from the surrounding environment to enter the breathing system through opening 134 and prevent suffocation of the pilot.

If the pilot bails out over water, upon touchdown, the breathing mask 20 may be retained on the face if it is judged easier to breathe without worry of being swamped by a wave. When a inhalation demand by the pilot exceeds the available breathable fluid in the emergency container 162, spring 104 is overcome and air from the surrounding environment is allowed to enter the breathing system through opening 134. If opening 134 is under water, hydrophobic membrane 120 prevents water from entering opening 94 when the poppet valve means 96 opens. Thereafter, when the opening 134 is out of water, air can enter the opening 94 by passing through the hydrophobic filter 120. Thus, only air from the surrounding environment is communicated to the breathing system 10 and the pilot is protected from drowning when the poppet valve means 96 is opened.

We claim:

1. Anti-suffocation means for allowing the communication of air from a surrounding environment into a breathing system in an emergency condition when a source of breathable fluid is insufficient to meet an inhalation demand of a recipient, said anti-suffocation means comprising:

a housing having a bore therein adapted to be connected to said breathing system, said housing having an opening connecting said bore to the surrounding environment;

valve means responsive to said inhalation demand for allowing communication of air through said opening;

filter means connected to said opening, said filter having a microporous membrane means for forming a barrier through which the transmission of water is inhibited to prevent contamination of the breathing system by any water present in the surrounding environment during the operation of said valve means by said inhalation demand;

clip means attached to said housing for sealing said opening from the surrounding environment prior to said emergency condition; and means for removing said clip means from the housing when an emergency condition occurs to allow said anti-suffocation means to operate should the recipient present a predetermined inhalation demand on said breathing system.

2. The anti-suffocation means, as recited in claim 1, wherein said clip removal means includes:

a lanyard means having one end attached to said clip means and an opposite end adapted to be attached to an aircraft for retaining said clip means in the aircraft to allow said valve means to immediately respond to inhalation demands should the recipient be required to agress from an aircraft in a bailout situation.

3. The anti-suffocation means as recited in claim 2 further including:

means for protecting said valve means from any direct wind forces to prevent the operation of said valve means by an outside wind force during descent in the bailout situation.

4. The anti-suffocation means, as recited in claim 1, wherein said valve means includes:

seat means secured to said housing;

poppet means located in said chamber; and resilient means for biasing said poppet means into contact with said seat means to prevent communication of breathable fluid from said chamber through said opening into the surrounding environment.

5. The anti-suffocation means, as recited in claim 2, wherein said valve means further includes:

guide means secured to said housing for maintaining said poppet means in alignment with said seat.

6. The anti-suffocation means, as recited in claim 1, wherein said membrane includes:

a layer of microporous film having an average pore size of between 0.20 to 0.80 microns.

7. The anti-suffocation means, as recited in claim 1, further including:

indicator means for warning a recipient of improper installation of said clip means which could allow air from the surrounding environment to enter the breathing system in response to a momentary inhalation demand.

* * * * *